US009605459B2

(12) United States Patent
Veino et al.

(10) Patent No.: US 9,605,459 B2
(45) Date of Patent: Mar. 28, 2017

(54) DOOR SYSTEM FOR AIRFLOW CONTROL

(71) Applicants: Clint Veino, Hampstead, NH (US); Bruce Long, Corrales, NM (US); Lars Strong, Santa Fe, NM (US)

(72) Inventors: Clint Veino, Hampstead, NH (US); Bruce Long, Corrales, NM (US); Lars Strong, Santa Fe, NM (US)

(73) Assignee: Upsite Technologies, Inc., Albuquerque, NM (US)

( * ) Notice: Subject to any disclaimer, the term of this patent is extended or adjusted under 35 U.S.C. 154(b) by 0 days.

(21) Appl. No.: 14/728,712

(22) Filed: Jun. 2, 2015

(65) Prior Publication Data

US 2015/0308172 A1 Oct. 29, 2015

Related U.S. Application Data

(63) Continuation of application No. PCT/US2015/027506, filed on Apr. 24, 2015.
(Continued)

(51) Int. Cl.
*E05D 7/12* (2006.01)
*E05D 7/10* (2006.01)
(Continued)

(52) U.S. Cl.
CPC ..... *E05D 7/123* (2013.01); *E05D 5/02* (2013.01); *E05D 7/1061* (2013.01); *E06B 3/36* (2013.01);
(Continued)

(58) Field of Classification Search
CPC ..... E05D 1/123; E05D 5/02; E05D 7/1061; E05D 2007/128; E06B 5/00; E06B 3/36;
(Continued)

(56) References Cited

U.S. PATENT DOCUMENTS 3,152,716 A * 10/1964 Feldhahn ..... A45C 13/005 16/320
3,537,166 A 11/1970 Matyas
(Continued)

FOREIGN PATENT DOCUMENTS

EP 1278033 B1 8/2005
FR 2955137 A1 * 7/2011 ..... E05D 1/00

OTHER PUBLICATIONS

Notification of Transmittal of the International Search Report and Written Opinion of the International Searching Authority or the Declaration Application No. PCT/US15/27506 Mailing Date: Jul. 31, 2015; Completion Date: Jul. 3, 2015 pp. 8.

*Primary Examiner* — Jerry Redman
(74) *Attorney, Agent, or Firm* — St. Onge Steward Johnston & Reens LLC

(57) ABSTRACT

A door system suitable for installation in data centers to limit airflow to and from aisles between rows of equipment cabinets has a door assembly with a door panel and a plurality of vertically spaced hinge assemblies having powerful permanent magnets manually movable between connected and disconnected positions, enabling the door assembly to be aligned and positioned on the side wall panel of an equipment cabinet and then removably mounted in place by engagement of the magnets. Each magnet can be mounted in a rotatable threaded magnet carriers received in a threaded recesses in the hinge assembly and rotation of the magnet carrier is operable to move the magnet into the connected and disconnected positions. The hinge assemblies also include registration tabs that engage slots in the cabinet for proper alignment and orientation of the door system.

20 Claims, 14 Drawing Sheets

Related U.S. Application Data

(60) Provisional application No. 61/983,680, filed on Apr. 24, 2014.

(51) Int. Cl.

| | |
|---|---|
| ***E06B 3/36*** | (2006.01) |
| ***E06B 5/00*** | (2006.01) |
| ***E05D 5/02*** | (2006.01) |
| *E06B 5/12* | (2006.01) |
| *E06B 7/23* | (2006.01) |

(52) U.S. Cl.
CPC ..... *E06B 5/00* (2013.01); *E05D 2007/128* (2013.01); *E05Y 2201/46* (2013.01); *E05Y 2600/12* (2013.01); *E05Y 2600/312* (2013.01); *E05Y 2900/208* (2013.01); *E06B 5/125* (2013.01); *E06B 7/231* (2013.01)

(58) Field of Classification Search
CPC ..... E05Y 2600/12; E05Y 2900/208; E05Y 2201/146
USPC ..... 49/381; 16/320, 321, 385
See application file for complete search history.

(56) References Cited

U.S. PATENT DOCUMENTS 3,707,017 A * 12/1972 Paquette ..... E05D 1/00 16/385
3,806,852 A 4/1974 Suska
4,434,524 A * 3/1984 Gilchrist ..... E05F 1/00 16/250
4,574,426 A 3/1986 Pearson
5,210,906 A * 5/1993 Aihara ..... B60R 7/04 16/232
5,215,367 A 6/1993 Montuoro et al.
5,235,933 A 8/1993 Pare et al.
7,089,627 B2 * 8/2006 Seidler ..... B65D 51/04 16/320
7,650,670 B2 1/2010 Baer et al.
7,657,971 B2 * 2/2010 Danko ..... E05D 1/00 16/320
7,841,199 B2 11/2010 VanGilder et al.
7,922,402 B2 4/2011 Gaertner et al.
8,156,753 B2 4/2012 VanGilder et al.
8,274,188 B2 9/2012 Evans
8,839,561 B2 * 9/2014 Yagi ..... E05D 1/06 16/320
9,121,207 B2 * 9/2015 Stuart
2004/0134030 A1 * 7/2004 Seidler ..... A45D 33/20 16/320
2005/0268433 A1 * 12/2005 Seidler ..... B65D 51/04 16/320
2007/0151077 A1 * 7/2007 Wei ..... E05F 1/00 16/320
2007/0157432 A1 * 7/2007 Weinstein ..... E05D 11/00 16/320
2012/0268891 A1 * 10/2012 Cencioni ..... G06F 1/1626 361/679.55
2013/0080762 A1 * 3/2013 Cretella, Jr. ..... G06F 1/1626 713/100
2013/0114039 A1 * 5/2013 Zelazowski ..... G02C 5/2209 351/153
2014/0265781 A1 * 9/2014 Rader ..... E05D 1/00 312/319.2

* cited by examiner

DOOR SYSTEM FOR AIRFLOW CONTROL

FIELD OF THE INVENTION

The present invention relates to airflow control devices and, in particular to door systems for airflow control in data centers.

BACKGROUND OF THE INVENTION

Modern data centers house large numbers of computer servers and other electronic equipment, typically housed in rows of equipment cabinets, in which a plurality of devices are mounted in a closely spaced relation within the cabinets. In operation, the densely arranged devices generate substantial heat, which must be removed in order to prevent overheating and malfunction of the equipment. The individual devices are generally provided with internal fans, which pull cooling air through the unit. However, because of the high density of the equipment, it is customary to provide substantial air conditioning systems to supply cooled air to the fronts of the cabinets, available to be drawn through the individual servers by their internal fans.

Operating efficiency of the cooling systems has become an increasing problem as the power output of the servers has been progressively increased and the expense of cooling them has become very meaningful. A significant aspect of controlling cooling costs is the prevention or minimization of mixing of the cooled air at the front of the cabinet with warm air in the data center. Where mixing is allowed to occur outside of the servers, the efficiency of the A/C equipment is compromised due to the lower temperature differential between the air returned to and the cooled air delivered by the NC equipment. Accordingly, the capacity of the A/C equipment must be enlarged, resulting in increased capital investment and increased operational expense.

Among the techniques employed at modern data centers to improve efficiency is arranging rows of server cabinets in hot- and cold-air aisles. Typically, two rows of server cabinets are oriented back-to-back, with cool air being supplied to the fronts of the rows (forming cold aisles) and warm air being collected in the hot aisle between the two rows, which is then returned to the A/C unit. This technique represents an improvement over previous arrangements but still permits considerable quantities of the cool air to bypass the servers and mix with warm air.

Other techniques employed in modern data centers are complete air containment (i.e., complete enclosure) and partial air containment. Complete air containment involves completely closing off an aisle, for example a cold-air aisle, between rows of server cabinets. In complete air containment, roof baffles are connected between the top portions of adjacent rows of server cabinets, to create an upper barrier, and doors (or walls) are connected between side portions of the cabinets at the ends of adjacent rows, to create side barriers. The floor of the server room and the cabinets provide the remaining sides of the complete enclosure. In a cold-air aisle, for example, perforations in the floor panels allow cooled air to flow into the enclosed cold-air aisle and then to the servers.

In partial air containment systems, the system does not completely enclose the area between adjacent rows of cabinets. The purpose and intention of partial air containment systems is to inhibit undesirable airflow, but at the same time provide benefits of an open aisle configuration.

The present invention seeks to provide improved arrangements for closing or partly closing the ends of the access aisles using novel door assemblies that can be quickly and conveniently installed and uninstalled in order to accommodate the changing configurations and requirements of typical modern data centers.

SUMMARY OF THE INVENTION

The door system of the invention provides a tool-less, modular and reusable air containment system designed, and particular suitable for, modern data centers. The system is highly configurable and effectively isolates hot and cold air mixing between adjacent hot- and cold-air aisles in an efficient and cost-effective manner.

The door system is suitable to manage airflow to and from an aisle formed by adjacent rows of equipment cabinets, and other uses. The door system includes a door panel and at least one hinge assembly secured to the door panel. The hinge assembly has a base forming a mounting surface operable to contact a vertical support, and the hinge assembly has at least one magnet operable for magnetic connection to a metallic portion of the vertical support. The magnet is selectively movable relative to the base into a connected position wherein the magnet is positioned to magnetically mount the hinge assembly to the vertical support, and the magnet is selectively movable into a disconnected position wherein the magnet is positioned to allow removal of hinge assembly from the vertical support.

The magnet has a contact surface and, in the connected position, the contact surface of the magnet is substantially coplanar with the mounting surface of the base of the hinge assembly. In the disconnected position, the contact surface of the magnet is substantially spaced from the mounting surface of the base, and is displaced in a direction perpendicular to the mounting surface of the base, relative to the position of the contact surface of the magnet in the connected position.

The hinge assembly has a cylindrical recess fixed relative to the base and the cylindrical recess has first threads, for example internal threads. The hinge assembly has a magnet carrier having a cylindrical portion with second threads, for example external threads, which are engaged with the first threads of the cylindrical recess. The magnet is connected to the magnet carrier and is selectively movable into the connected and disconnected positions by rotation of the magnet carrier relative to the base. The magnet carrier has a manually engageable gripping element for controlled rotation of the magnet carrier with respect to the base to selectively move the magnet into the connected and disconnected positions.

The hinge assembly has a vertically aligned registration tab projecting from the base which is adapted to engage a vertical slot in the vertical support structure, and preferably two of said hinge assemblies are provided with said registration tabs. A vertically adjustable leveling foot is mounted to the hinge assembly, and the leveling foot being operable to engage a floor surface.

A vertically adjustable door support assembly is mounted to the hinge assembly, and the door support assembly includes a hanger bracket of inverted L-shaped configuration having vertical and horizontal bracket elements. A magnet is secured to the horizontal bracket element for engagement with a horizontal support, and the vertical bracket element is connected to the base of the hinge assembly and is vertically adjustable with respect to the base. The base of the hinge assembly has a lateral extension, and the vertical bracket element being connected to the lateral extension. The lateral extension of the base having a plurality of outwardly projecting threaded studs. The vertical bracket element having a plurality of vertically elongated slots aligned with said threaded studs, and an internally threaded knob engaging each of the threaded studs for manually securing the vertical bracket element to the lateral extension.

The door system can be installed in data center environment having a first row of equipment cabinets, where the vertical support surface comprises a metallic portion of a side wall of an equipment cabinet in the first row, and the hinge assembly is mounted to the first side wall. A second row of equipment cabinets forms an aisle between the first and second row, and the door panel extends into the aisle.

DETAILED DESCRIPTION OF THE INVENTION

Figure 1:
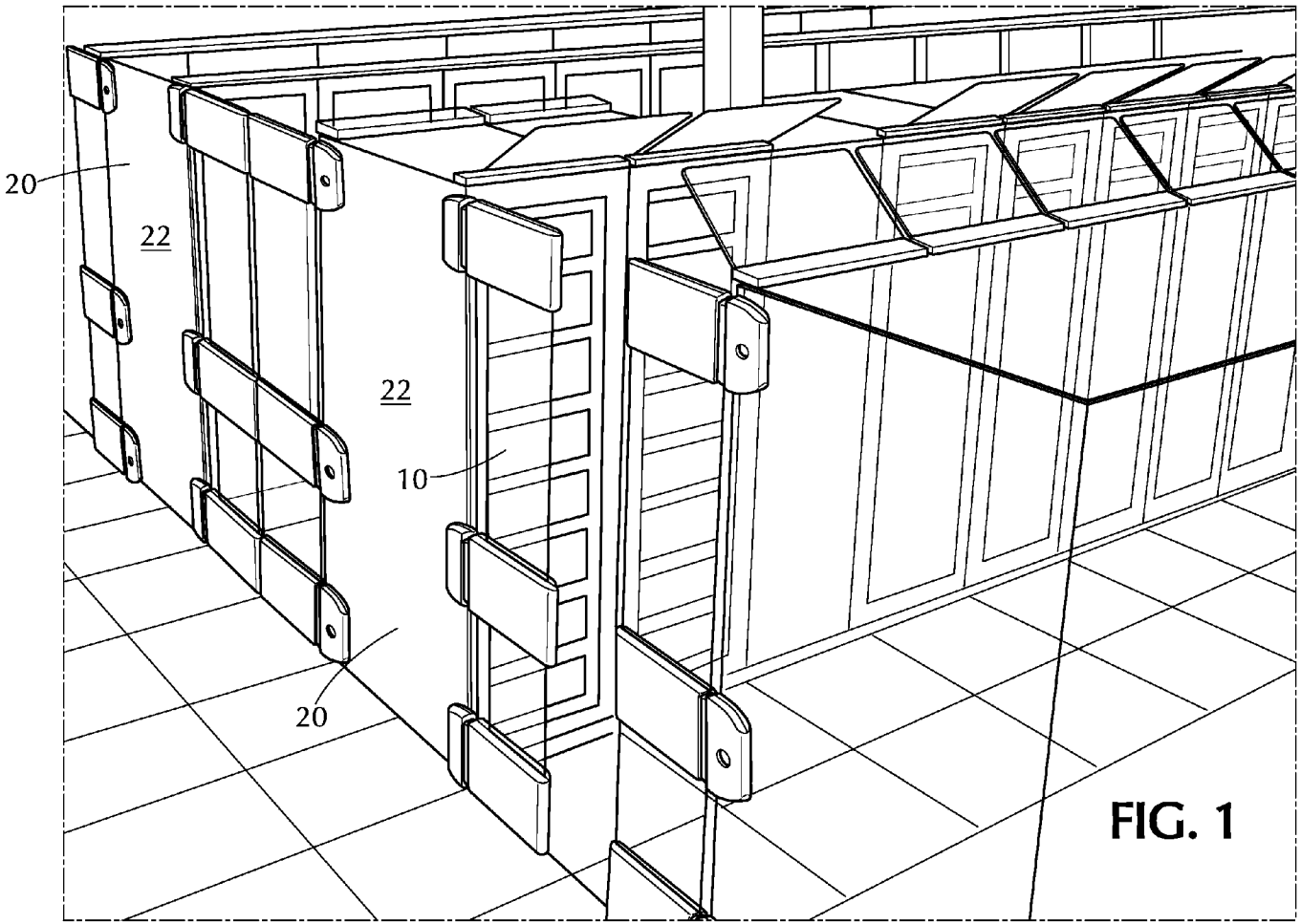
FIG. 1 is a perspective view of an embodiment of a door system constructed in accordance with the invention, in a data center environment.

Referring to FIG. 1, the door system provides a modular and reusable air containment system which is particularly suitable for modern data centers having rows of cabinets for servers and other computer equipment oriented back-to-back, with cool air being supplied to the fronts of the rows (forming cold aisles) and warm air being collected in the hot aisle between the two rows, which is then returned to the NC unit. The new door system can be installed in few minutes, right out of the box, without the need for tools, and serves to effectively isolate hot- and cold-air aisles in an efficient and cost-effective manner.

A pair of door assemblies 12 can attach to side wall panels 20 of opposed equipment cabinets 22 at the end of an access aisle (or to other support structure, such as a support column). The doors inhibit horizontal airflow into and out of the aisle to reduce hot- and cold-air mixing which is otherwise a common problem at the ends of the aisles. The doors can also slightly increase pressure in the aisle, which, in the cold-air aisle, can improve airflow and reduce server inlet temperatures, especially at the ends of rows of servers.

Typically, the width of an aisle, that is, the distance separating adjacent rows of cabinets in an aisle, is about 48 inches. The door panel assemblies 12 can be provided in pairs each having, for example, a width of 15 inches such that, when closed, a pair of door assemblies 12 will provide a gap between their opposed outer edges of about 18 inches, which may be suitable for use in a cold-air aisle. Alternately, the door assemblies 12 can be provided in pairs having widths of about 23 inches, such that when the doors are closed there is a small gap of 1-2 inches between them, in order to substantially fully close off the aisle, as may be suitable for use in a hot-air aisle. Alternatively, a single door can be provided, for example in a width of about 48 inches, to completely close an aisle, or in another width. The doors preferably have a height substantially equal to the height of the cabinets, for example 78.3 inches to 82.5 inches.

Referring FIGS. 2-16, in an embodiment of the invention, the door system 10 includes a door panel assembly 12 supported by vertically spaced hinge assemblies 14, 16, 18 (for example three hinge assemblies) which connect the door assembly to a vertical support structure, such as a side wall panel 20 of a server cabinet 22 or other suitable structure. A typical server cabinet 22 will have vertical side wall panels 20 and a horizontal top panel 23, which are typically orthogonal.

Figure 2:
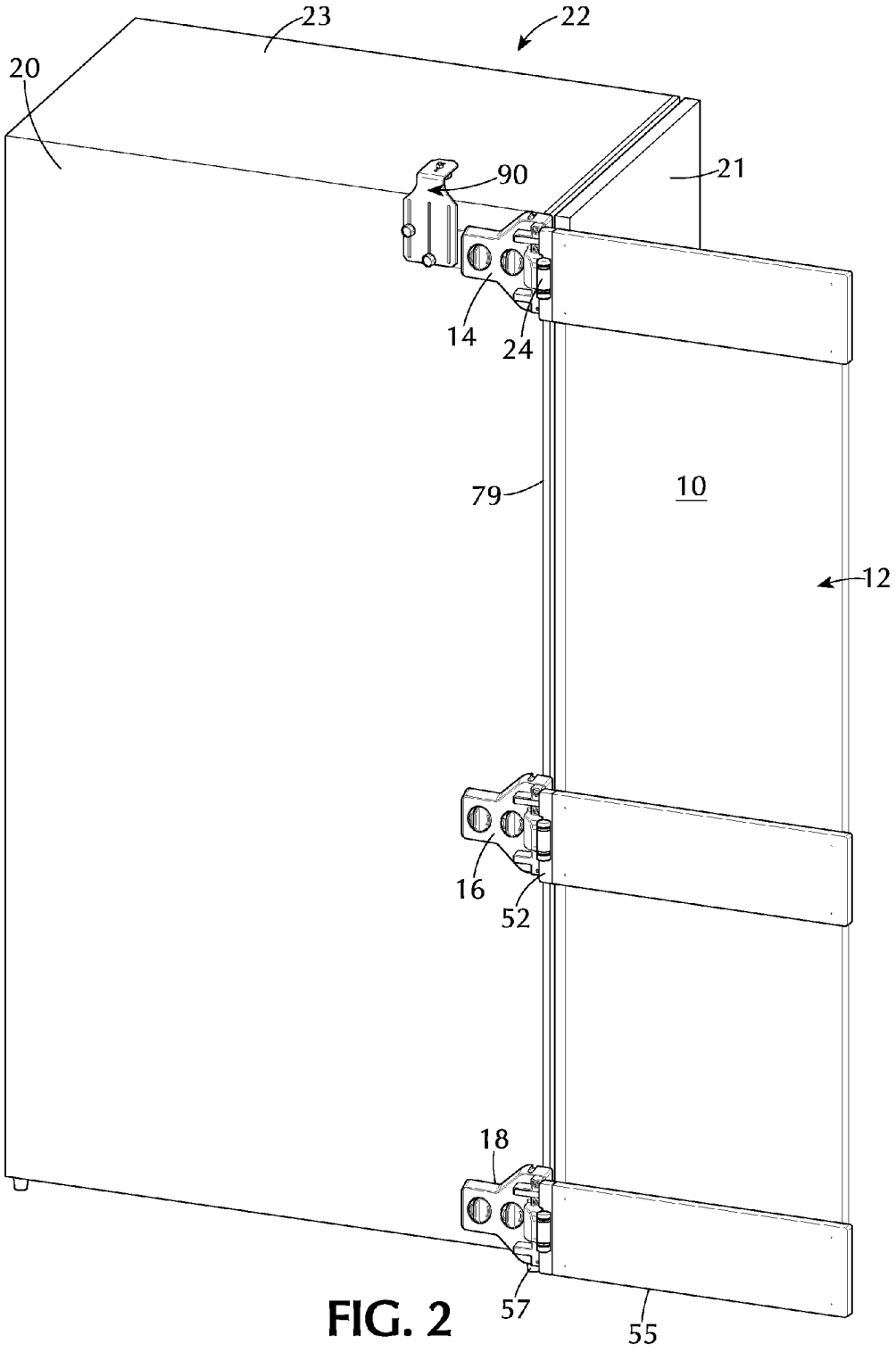
FIG. 2 is a perspective view of an embodiment of the door system showing an equipment cabinet with a door assembly mounted on a side thereof.
Figure 3:
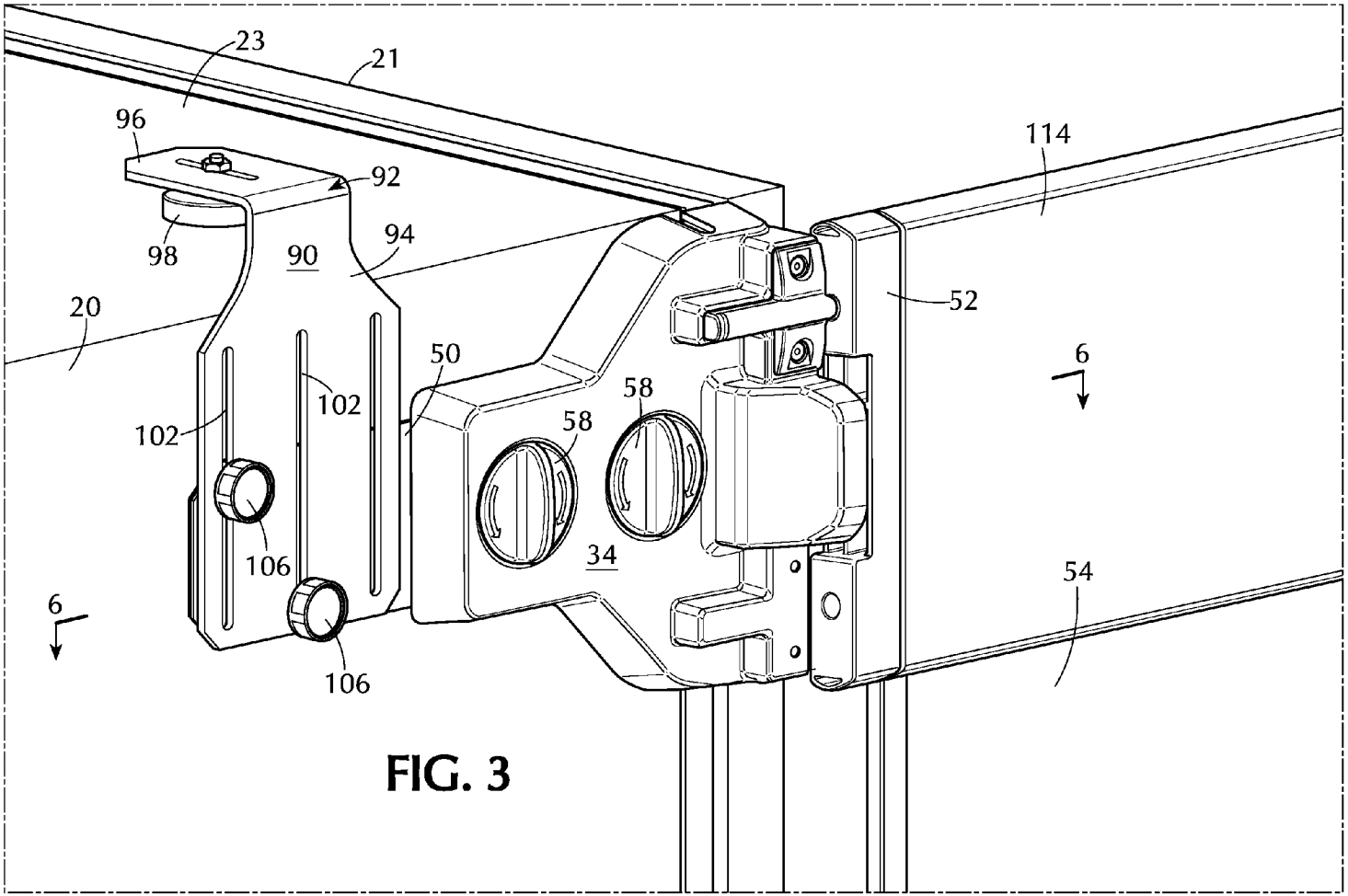
FIG. 3 is an enlarged perspective view of the door system of FIG. 2.
Figure 4:
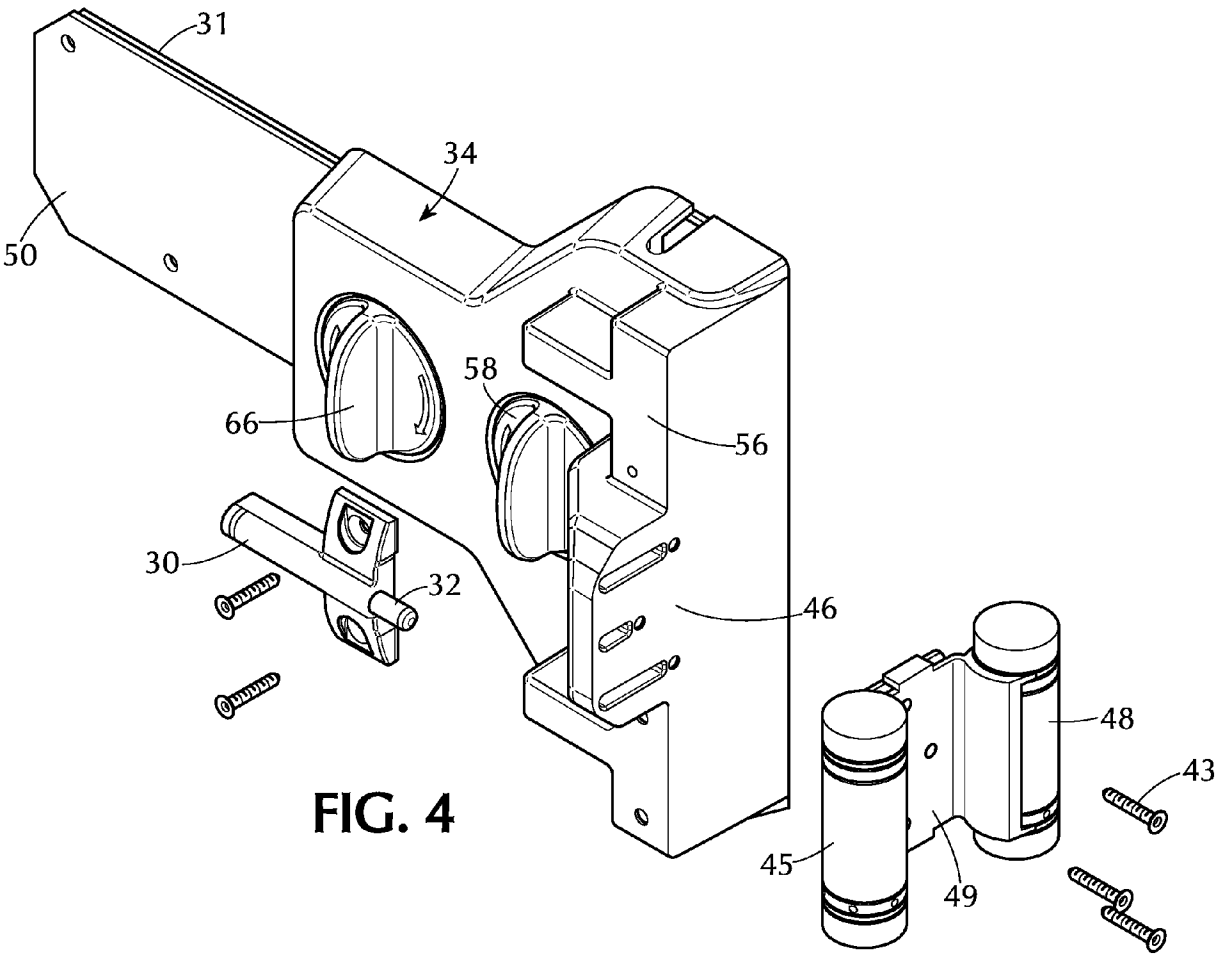
FIG. 4 is an exploded perspective view showing features of the hinge assembly of the door system of FIG. 3.
Figure 5:
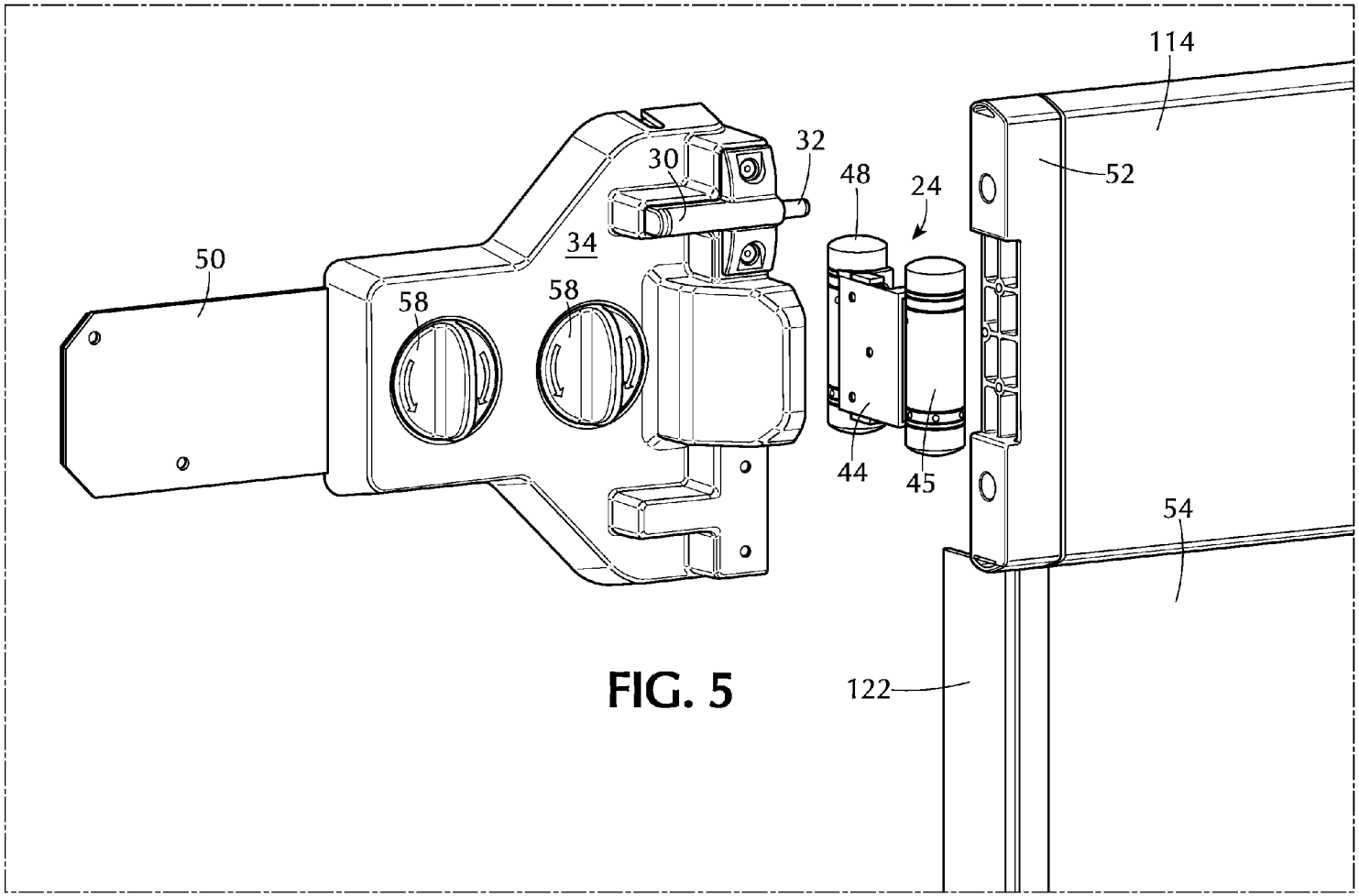
FIG. 5 is an exploded perspective view showing the hinge assembly of FIG. 3 and the manner of its attachment to a door panel.
Figure 14:
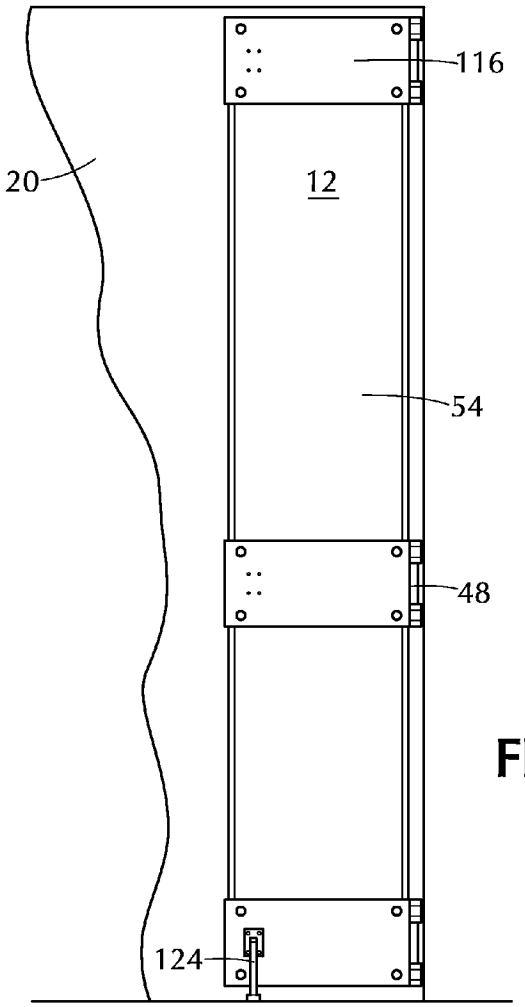
FIG. 14 is a fragmentary side elevational view of a server cabinet on which a door assembly according to the invention is mounted, the door assembly being displayed in an outwardly open position.

Each hinge assembly 14, 16, 18 preferably includes a saloon-style, double-acting hinge 24 which permits the door to swing in either direction (i.e., bi-directional) and includes a bias, such as a spring bias, which biases the door assembly 12 into a closed, or rest, position (as depicted in FIGS. 1 and 2). Preferably, the double-acting hinges 24 provides the door with at least 270 degrees of overall movement such that the door can open fully both into and out of an aisle. Specifically, the hinges 24 preferably permit the door to pivot inwardly at least 90 degrees from the closed/rest position into the aisle, such that the door can be effectively folded against, or closely adjacent to and substantially parallel to, the front 21 of the cabinet 22 to which it is attached. Further the hinges 24 permit the door to pivot in an opposite direction (i.e., outward and away from the aisle), at least 180 degrees from the closed or rest position, as shown in FIG. 14, such that the door can be substantially folded against or closely adjacent, and substantially parallel to the side wall panel 20 of the cabinet 22.

The double acting hinges 24 are positioned such that, as the door pivots into the aisle, a door panel 54 (FIG. 6) will pivot about a first pivot axis 27 and fold against the front panel 21 but will not engage or contact the corner of the cabinet 22 formed by the side and front 20, 23 panels. To this end, the first pivot axis 27 and a second pivot axis 28 of the double acting hinges 24 are vertically oriented and preferably positioned adjacent to but spaced a short distance rearwardly from a plane 25 in which the (aisle-facing) front panel 21 of the cabinet 22 lies. In particular, the first pivot axis 27 of the hinge 24, located adjacent the side 20 of the cabinet 22, is spaced rearwardly from the front panel plane 25 a distance less than or equal to a distance between the first pivot axis 27 and a plane 29 in which an inner surface 80 of the door panel 54 lies when in the closed/rest position. To assist in this alignment, each hinge assembly 14, 16, 18 preferably includes a vertically aligned registration tab 78

Figure 11:
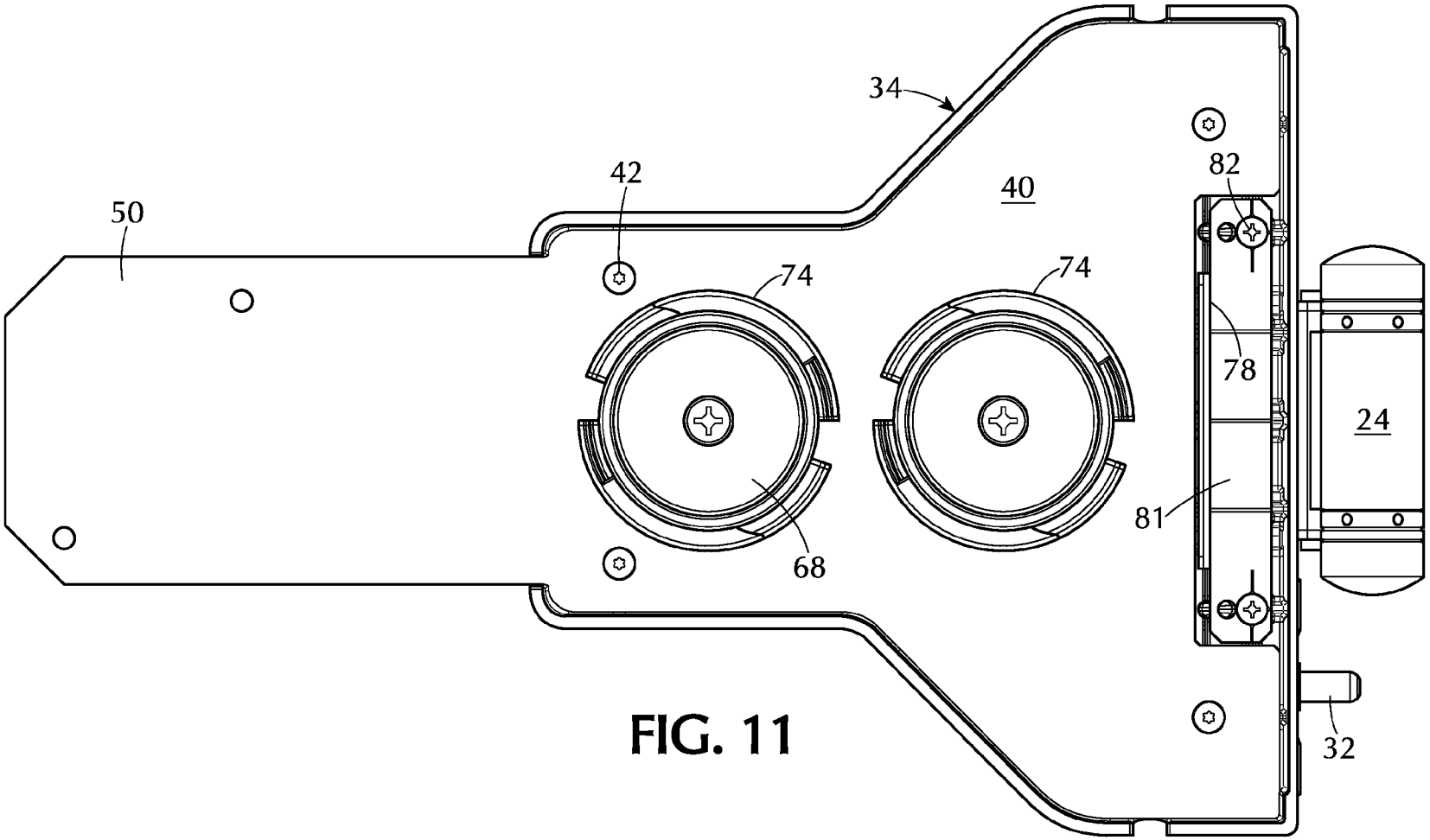
FIG. 11 is a rear view of a top hinge assembly incorporated into the door assembly of the invention.
Figure 12:
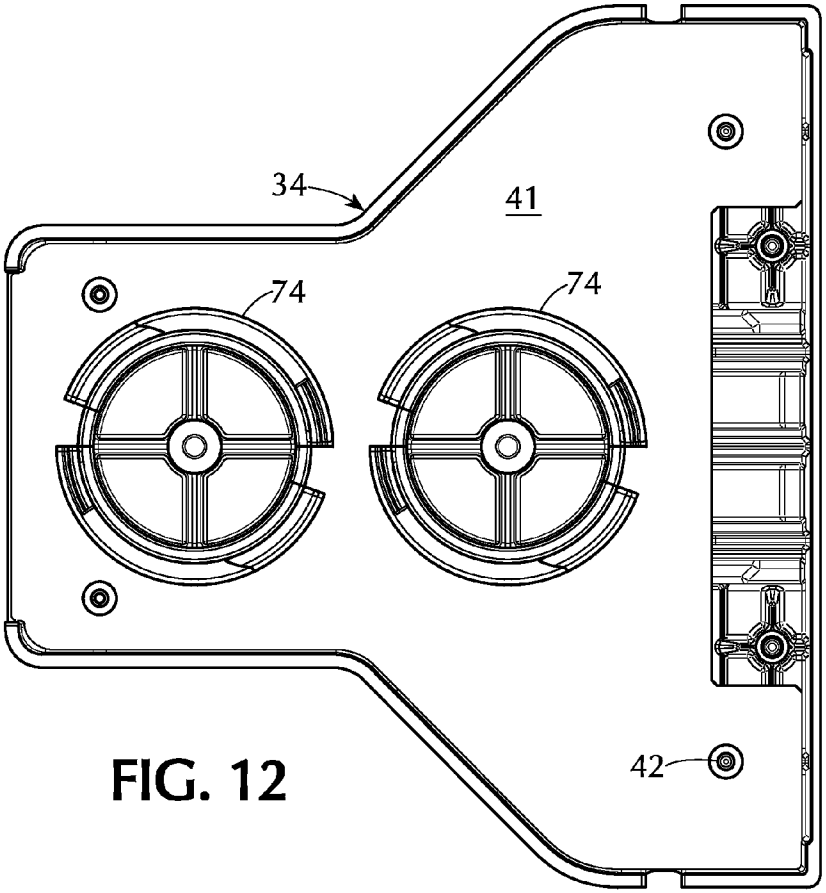
FIG. 12 is a rear view of a lower hinge assembly incorporated into the door assembly of the invention.
Figure 13:
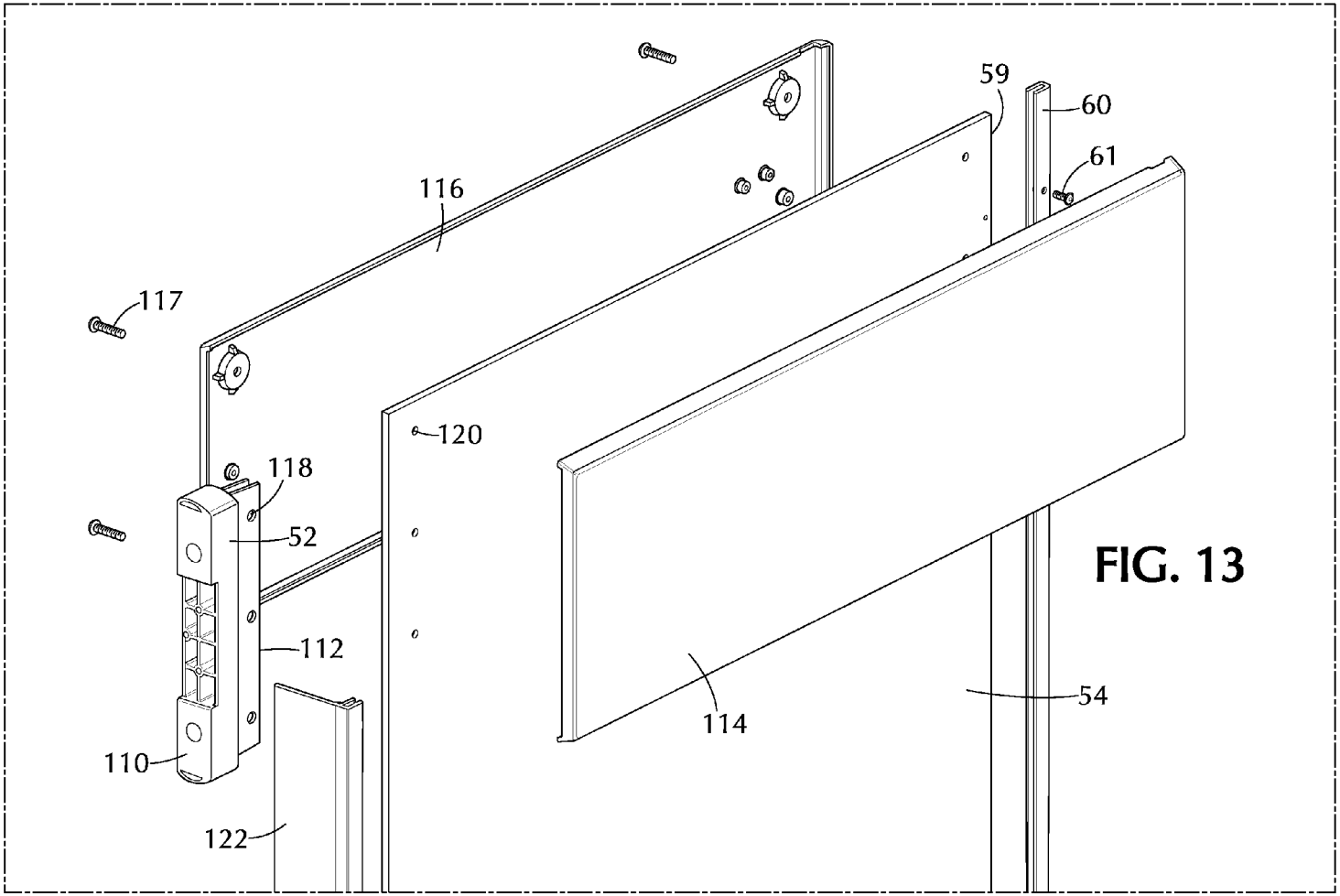
FIG. 13 is an exploded perspective view showing features of a door panel assembly and mounting arrangement.

(FIG. 6) extending perpendicularly from a cabinet-facing side of a hinge housing 34 or base 40 and positioned to align with and extend into a vertical gap 79 formed in the side 20 of the cabinet 22 (e.g., between the cabinet frame and a cabinet door provided at the front of the cabinet), to provide for a proper and consistent positioning and alignment of the hinge assemblies, and the door panels supported thereby, relative to the cabinet. In the illustrated embodiment of the invention, the registration tab 78 is secured to the hinge housing 34 by a base portion 81 disposed at right angles to the tab 78 and secured by screws 82 or other means (FIG. 11).

Each of the hinge assemblies 14, 16, 18 can include a hinge housing 34 and a hinge base 40 (FIGS. 6, 11, 12) (FIG. 12) connected to the hinge housing. Each hinge housing 34 is preferably formed of injection-molded plastic and each hinge base 40 is preferably formed of metal. However, other suitable materials may be used for these components. Each double-acting hinge 24 is attached, by screws 43 of other suitable fastening means, to a hinge mounting surface 46 of the associated hinge housing 34. The hinge mounting surface 46 preferably is oriented perpendicular to the hinge base 40 and side wall panel 20 of the server cabinet 22, and parallel to the front 21 of the server cabinet 22. In the closed or rest position, the door panel 54 of the door assembly 12 is substantially parallel to the hinge base 40 and to the side 20 of the cabinet 22, and is perpendicular to the front 21 of the cabinet 22.

The double acting hinges 24 can comprise a first mounting plate 44 (FIG. 6) secured in fixed relation to the hinge housing 34 by the screws 43. The first mounting plate 44 mounts a first spring hinge assembly 45. The first spring hinge assembly 45 is fixed to one edge of a second mounting plate 47 which normally directly overlies the first mounting plate 44 and is fixed at its opposite edge to a second spring hinge assembly 48. The second spring hinge assembly 48 is fixed to one edge of a third mounting plate 49 which normally overlies the second mounting plate and in turn is fixed to a door-attachment bracket 52 by screws 53. When the door assembly 12 swings outwardly, an entire subassembly of the door panel 54, its mounting bracket 52, the second spring hinge assembly 48 and the second and third mounting plates 47, 49 pivot about the axis 28 of the first spring hinge assembly 45. When the door assembly swings inwardly, the only the door panel 54, bracket 52 and third mounting plate 49 pivot about the axis 27 of the second spring hinge assembly 48. When swung in either direction, the spring action of the spring hinge assembly 45 or 48 tends to return the door assembly to its rest position, wherein the door is parallel to the side 20 of the server cabinet 22, and perpendicular to a front 21 of the cabinet.

One or more of the hinge assemblies 14, 16, 18 of each door panel assembly 12 can include a damper 30 which engages the door assembly 12 to dampen the rotation of the door assembly 12 as it swings back from an opened position. Each damper 30 is attached to a damper mounting surface 56 of the associated hinge housing 34 which is spaced from and parallel to the hinge base 40. The damper 30 can be a piston-type damper having a piston 32 oriented to move parallel to the hinge base 40 and aligned to engage and resist the approach of an associated door attachment bracket 52 of the door assembly 12, as the door panel assembly 12 swings back into the closed (rest) position after either an inward or outward opening of the door.

Figure 6:
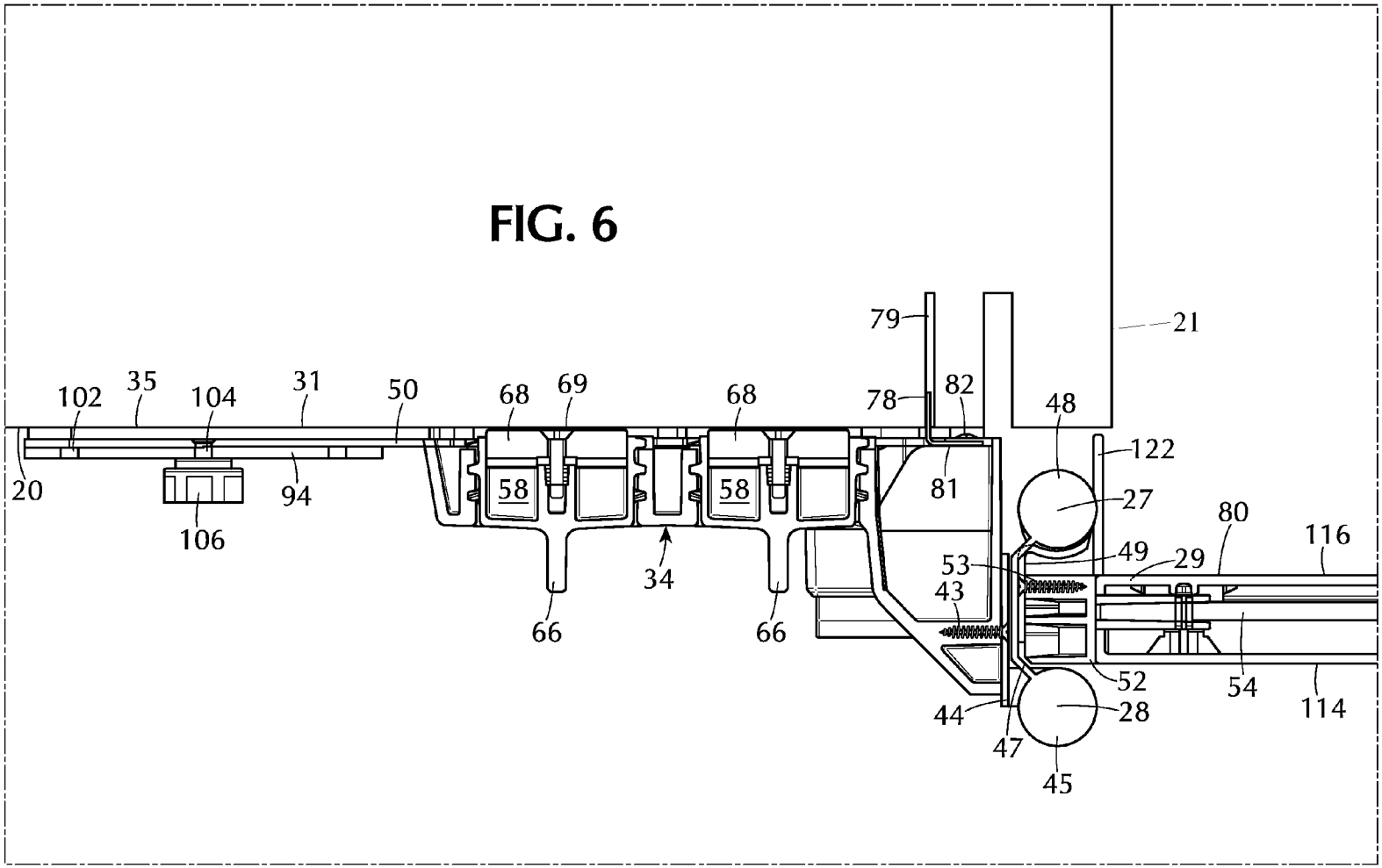
FIG. 6 is a fragmentary cross sectional view as taken generally along line 6-6 of FIG. 3.
Figure 9:
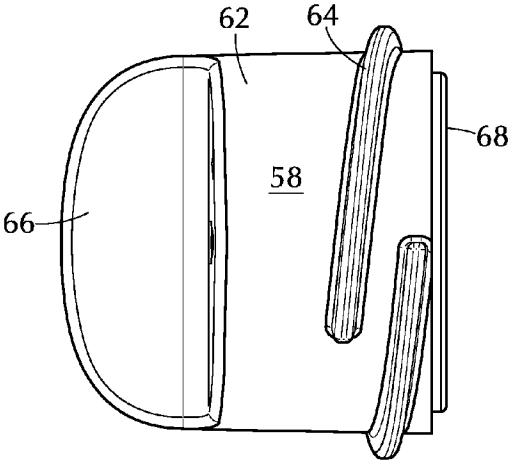
FIGS. 7, 8 and 9 are a front perspective view, a rear perspective view, and a side elevational view, respectively, of a magnet assembly forming a part of the invention.
Figure 8:
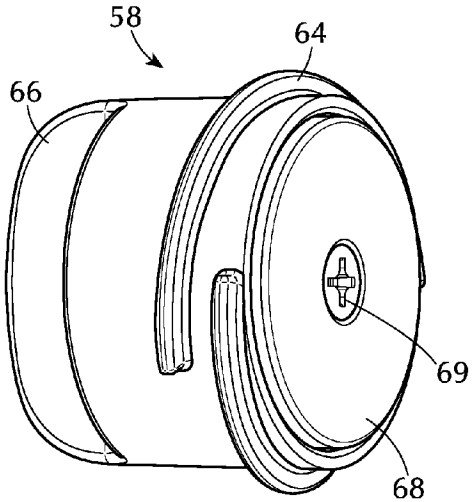
Figure 7:
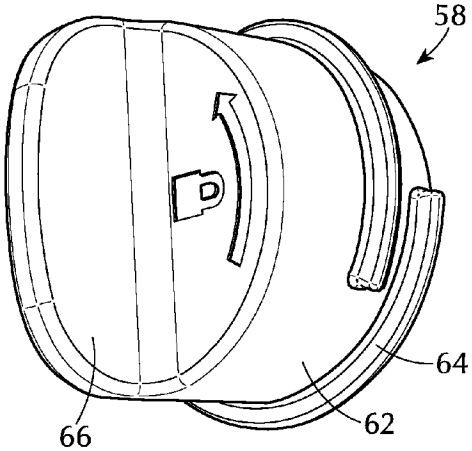
Figure 10:
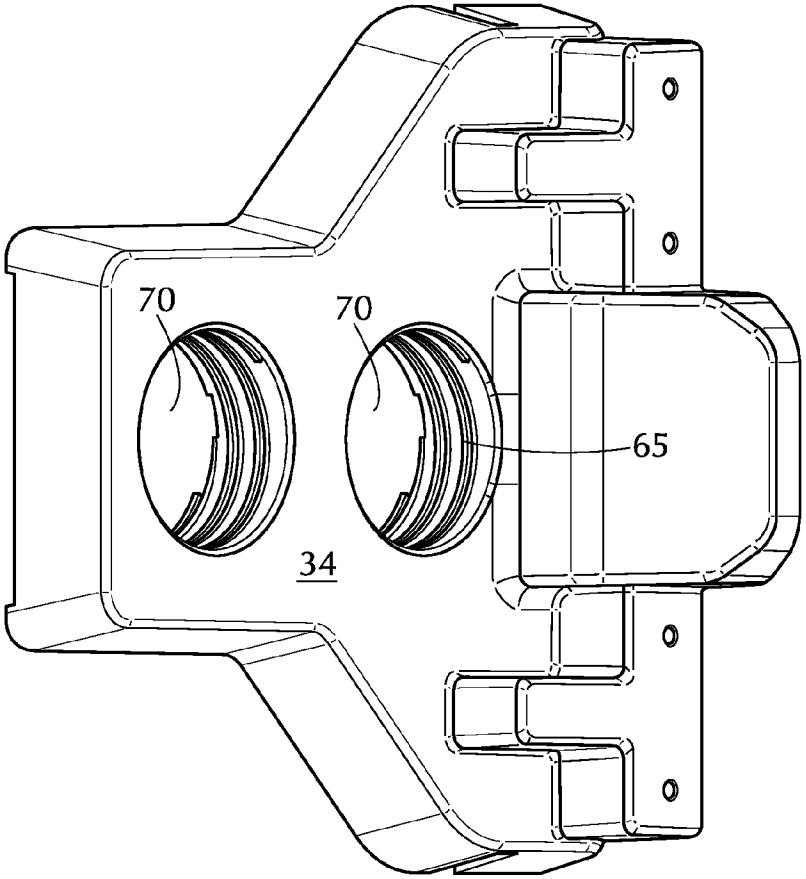
FIG. 10 is a perspective view of a hinge housing forming a part of the invention.

The door assembly 12 preferably includes one or more sealing strips 122 along the length of the inner edge of the door panel 54 to fill a gap between the door panel and the cabinet, at least when the door is in the rest position (FIG. 6). Further, the door assembly 12 preferably includes a flip-down type door stop 124 connected to an inner surface of the door panel which can engage the floor to maintain the door in a position and in particular any outwardly open position.

When mounted to the cabinet 22, a back 35 of the hinge housing 34, and/or a mounting surface of the base 40 are in contact with the side wall panel 20 of the cabinet 22, and a front 37 of the hinge housing 34 faces laterally outward from the side wall 20 of the cabinet. Preferably, the base 40 includes a thin, resiliently deformable pad 31, which can be formed of rubber or neoprene for another suitable material, forming at least a part of a cabinet-facing mounting surface of the base 40. A purpose of the resilient pad 31 is to provide a high-friction surface contacting the side wall panel 20, so that the hinge assemblies do not slide on the surface of the side wall panel 20.

Each hinge assembly 14, 16, 18 includes one or more (preferably two, spaced apart) magnet assemblies 58 which are adapted to removably magnetically connect the hinge assembly to the side wall panel 20 of the outermost server cabinet 22 to support the door system 10. Each magnet assembly 58 is hand-rotatable (i.e., twistable) in a manner that permits the magnet assembly 58 to be selectively connected to and disconnected from the server cabinet (or other magnetic structure) by appropriate rotation of the magnet assembly.

Each magnet assembly 58 has a hollow, cylindrical magnet carrier 62, preferably of molded plastic, which is provided with external threads 64 and with a gripping element 66 extending from a top of the magnet carrier 62. A permanent magnet 68 is mounted within the magnet carrier 62 by a fastener, such as screw 69 or other suitable fastening means. In a typical installation, the magnet 68 can be cylindrical (e.g., annular) and can have a diameter of about 1.5 inches and a thickness of about ⅜ inches. The magnet 68 can be formed of a very strongly magnetized rare earth magnet or other suitable material, such as ferrite, Alnico, MdFeB or the like and each can provide about 100 lbs of pull strength, for a total of over 200 lbs of pull strength for each hinge assembly having two magnet assemblies. Preferably, the magnets 68 are ring magnets and are axial magnetized. The magnets 68 are preferably aligned with the polarization in the same direction (for example perpendicular toward or away from the side wall 20 of the cabinet 22) such that overlapping or adjacent portions of the magnetic fields thereof do not interfere and/or are additive.

The gripping element 66 preferably spans the full diameter of the magnet carrier 62 and preferably has an axial length (height) of about ½ inch to provide sufficient grip and torque leverage to enable the magnet assembly 58 to be twisted by hand for disconnecting a hinge assembly 14, 16, 18 from a cabinet wall. A cabinet-facing contact surface of the magnet 68 preferably extends outwardly from a bottom of the magnet carrier 62 at least a short distance (FIG. 9) to allow the magnet to contact the side wall panel 20 of the cabinet 22 when the hinge assembly is being connected.

For each magnet assembly 58, the hinge assemblies includes a magnet-receiving through recess 70 which is preferably substantially cylindrical, with a center axis aligned perpendicular to the associated hinge base 40 and to the side wall panel 20 of the server cabinet 22, when connected. Each magnet-receiving recess 70 can have internal threads 65 adapted to receive external threads 64 of a rotatable magnet assembly 58. Each hinge base 40 and the resilient pad 31 thereof preferably includes substantially circular through openings 74 which are aligned with an associated magnet-receiving recess 70 of the hinge housing 34 (FIGS. 6, 11, 13) and are sized and shaped to permit the magnet 68 and/or the magnet carrier 62 and to pass therethrough. Adjacent recesses 70 are preferably spaced apart about 0.5 to about 0.75 inches, with the centers thereof spaced apart about 2.0 to 2.25 inches, but not limited thereto.

Preferably, the internal threads of the magnet-receiving recesses 70 extend to a cabinet-facing end of the recesses 70 to allow the magnet assemblies 58 to be threaded into and removed from the recesses 70, through the plate and pad openings 74, from a cabinet-facing side of the hinge assemblies 14, 16, 18. However, the internal threads of the recesses 70 preferably terminate before opposite (i.e., outer) ends of the recesses 70, thus forming outer limit stops to prevent the magnet assemblies 58 from being removed from the associated hinge housing 24 through the outer ends of the recesses.

Rotation of the magnet assembly 58 within the magnet receiving recess 70 causes the magnet assembly 58 to move toward or away from the back 35 of the hinge housing 34 and/or the base 40, and thus toward or away from the side wall panel 20 of the server cabinet 22 when the door assembly is positioned against the wall panel. Rotation of the magnet assembly 58 in one direction (preferably counter-clockwise) causes the associated hinge assembly to be selectively connected to the cabinet by moving the magnet 68 to a connected position in which the magnet 68 has a strong magnetic connection with the side wall panel 20 of the cabinet, preferably by being in direct contact with, or in very close proximity to, the side wall panel 20, to magnetically affix the door system 10 to the cabinet. Alternatively, rotation of the magnet assembly 58 in an opposite direction (e.g., clockwise) causes the associated hinge assembly to be selectively disconnected from the cabinet by displacing the magnet 68 away from the cabinet side wall panel to a disconnected position in which the magnet 68 does not have a strong magnetic connection with the side 20 of the cabinet, preferably about one-half inch from the cabinet side wall panel 20.

In the disconnected position, a contact surface (cabinet-facing surface) of the magnet 68 can be displaced in a direction perpendicular to the mounting surface of the base 40, relative to the contact surface of the magnet 68 in the connected position. In a preferred form of the invention, a distance between the connected and disconnected positions is preferably about 0.5 to about 0.75 inches and is preferably accomplished with a 90 to 270 degree turn (e.g., 180 degree turn) of the magnet assembly 58 relative to the base 40. Preferably, when the magnet assembly 58 is in the connected position, the contact surface of the magnet 68 is substantially co-planar with a mounting surface (cabinet-facing surface) of the base 40. When the magnet assembly 58 is moved to the connected position (but without actually being attached to a cabinet), the contact surface of the magnet 68 can be disposed between a cabinet-facing surface of the resilient pad 31 and an opposing surface of the pad 31. However, when the magnet assembly 58 is in this same connected position, but is actually attached to a cabinet, the strong attraction of the magnet 68 to the cabinet side wall panel 20 causes the resilient pad 31 to be compressed against the side wall panel 20, allowing the contact surface of the magnet 68 to contact the side wall panel 20 and providing enhanced frictional engagement between the hinge assembly and the cabinet 22.

If the magnet 68 is connected to the magnet holder 60 by a single screw 69 directed through a center of the magnet, the handedness of the threads 65, 64 of the recesses 70 and magnet assembly 58 are preferably opposite the handedness of the screw 69, to prevent unintended loosening of the screw 69 during disconnection of the hinge assembly from the cabinet 22, when the magnet initially will be subject to significant torque load. For example, if the threads of the screw 69 are right-handed, as is typical, the threads 65, 64 of the recesses 70 and magnet assemblies 58 are preferably left-handed, requiring a counter-clockwise rotation to connect the magnet assembly and a clockwise rotation to disconnect.

The door panel 54 of the door assembly 12 is preferably about 0.150 to about 0.200 inches thick and is constructed of transparent material, such as clear or tinted UL94V rated polycarbonate for maximum light transmissibility. However, other transparent, translucent or opaque materials are also suitable for the door panel. Each door attachment bracket 52 has a base 110 which is connected to an associated double-acting hinge 24 and has a channel portion 112 to receive and connect to the door panel 54. Inner and outer cover panels 114, 116, each having a height of about 6 to 7 inches, span the width of the door panel 54 and enclose the top, middle and bottom portions of the door. Fasteners 117 are directed through one of the panels, then through holes 118 in the attachment bracket 52 and aligned holes 120 in the door panel 54, and engage the opposite cover panel, to mount the door to the hinge assembly 14. If desired, the attachment bracket 52 and cover panels can be mounted to the top of the door panel 54 in two or more vertical positions to provide for adjustment in the height of the door assembly 12 by adjusting the position of the attachment bracket 52 upward such that the bottom two holes 118 in the bracket align with the top two holes in the door panel 54.

Preferably, two hinge assemblies 14, 18 are positioned at the top and bottom of the door assembly 12 and the associated inner and outer covers 114, 116 enclose the top and bottom edges of the door panel, respectively. The middle hinge assembly 16 also includes inner and outer covers 114, 116 and is preferably located at a height of about 30 inches from the bottom of the door panel to provide a protective contact surface for equipment carts that are typically used to transfer equipment into and out of server aisles.

The outer (free) edge 59 of the door panel 54 can be protected by a U-shaped channel section 60 which extends vertically along the outer edge 59 and is secured to the panel by means such as screws 61 or other suitable fasteners or means.

Figure 15:
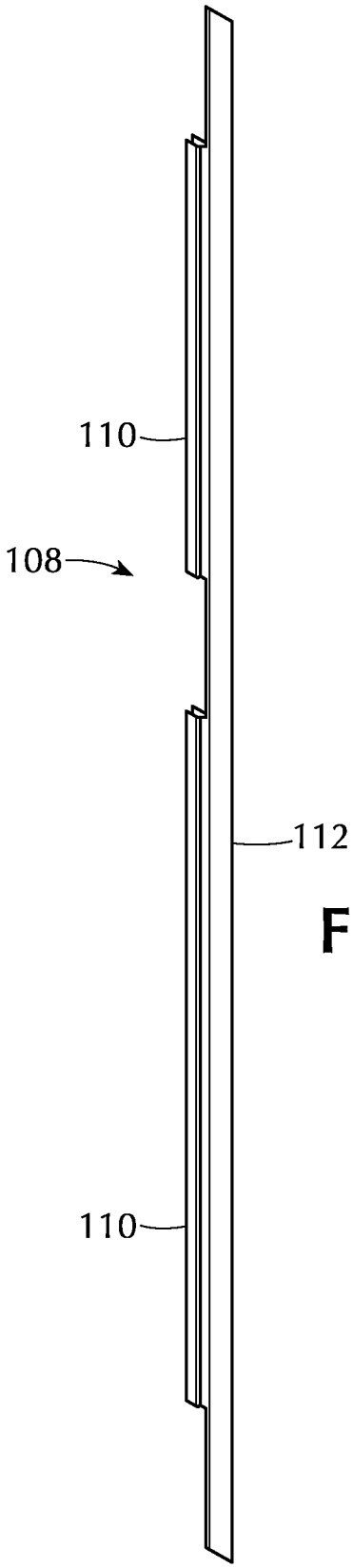
FIG. 15 is a perspective view of a sealing element optionally attachable to the door panel of the door system.
Figure 16:
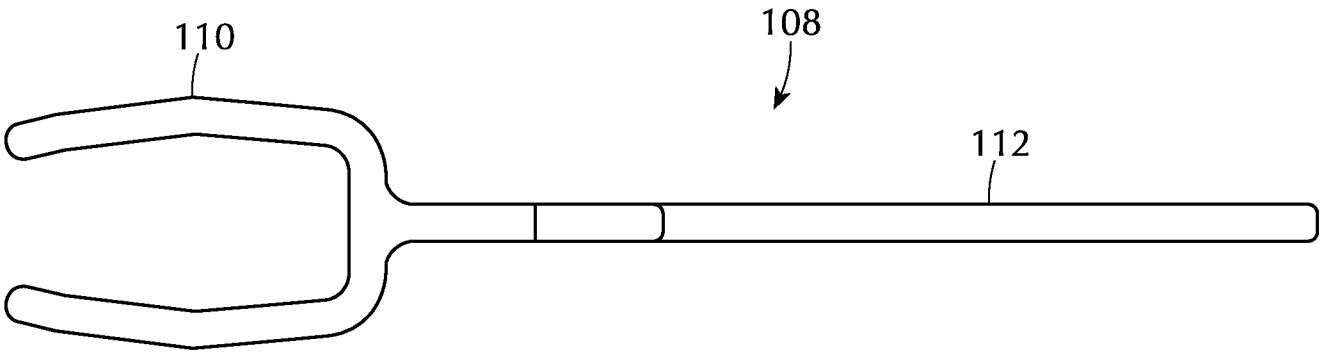
FIG. 16 is a top plan view of the sealing element of FIG. 15.

Referring to FIGS. 15-16, where it is desired to maximize the aisle confinement provided by the doors, one can optionally provide the door panel 54 with a resilient, flexible sealing strip 108 operable to mount to the outer edge 59 and/or channel section 60 of the door panel 54, which seal which can contact or engage an opposing door (or similar seal thereof) or other structure to seal a gap between the outer edge 59 and the other structure. The sealing strip 108 can include a mounting channel 110, in one or more (e.g., 2) sections, sized and shaped for removable mounting of the sealing strip 108 to the outer edge 59 and/or channel section 60 of the door panel 54. The sealing strip 108 can include a resiliently flexible sealing portion 112 extending from the mounting channel 110. When the sealing strip 108 is mounted to the door panel 54, the flexible sealing portion 112 extends outwardly from the outer edge 59 of the door panel 54 substantially parallel to a plane of the door panel 54, and can have a lateral width of about 4 inches.

To advantage, a door support assembly 90 can be connected to the uppermost hinge assembly 14 to further support the door system 10 from the top panel 23 of the server cabinet 22. The door support assembly 90 has an inverted L-shaped hanger bracket 92 having a vertical portion 94 connected to the lateral extension 50 of the hinge base 40 of the upper hinge assembly 14. The bracket 92 also has a horizontal arm portion 96 which extends over the top panel 23 of the cabinet 22. A magnet 98 such as described herein depends downwardly from the arm to magnetically attach the door support assembly 90 to the top 23 of the server cabinet 22. The vertical portion 94 of the hanger bracket 92 has several vertical slots 102 and the extension 50 of the hinge base 40 mounts two or more outwardly projecting threaded studs 104 arranged to be received in the slots 102. Internally threaded fastener knobs 106 engage the threaded studs and can be manually tightened to secure the bracket in position after it has been properly adjusted. This adjustment normally is done after the door has been initially mounted on the server by the magnets of the hinge assemblies 14, 16, 18.

Installation of a door assembly 12 can be accomplished quickly and entirely without tools. After removal of the door assembly 12 from its shipping container, the door is oriented vertically, with the hinge assemblies 14, 16, 18 against the side wall panel 20 of the server cabinet or other structure. The lower edge 55 of the door panel 54 (FIG. 2) is elevated slightly above the floor surface by a leveling foot 57 which is adjustably attached to the lower hinge assembly by means such as a vertically-aligned threaded rod. With the door assembly thus arranged and supported, the registration tabs 78 projecting from the backs of the hinge assemblies are fully inserted into the cabinet seam 79 to assure that the hinge assemblies are accurately positioned with respect to the front 21 of the server cabinet. The magnet assemblies 58 of one of the hinge assemblies (for example the middle hinge assembly 16) can then be rotated to advance the magnets 68 into the connected position, to magnetically mount the hinge assembly to the wall panel 20. At this stage, the door assembly is self-holding on the panel 20 but is capable of limited vertical adjustment up or down, as necessary, using the leveling foot 57, to achieve a minimal gap between the door panel 54 and the floor, preferably less then one inch. Following this vertical adjustment, the door assembly is firmly locked in place by rotating the magnet assemblies 58 of the other hinge assemblies, for example the upper and lower hinge assemblies 14, 18, into their connected positions.

Desirably, at this stage of the installation the door support assembly 90 can be completed by mounting the hanger bracket 92 on the studs 104 and sliding it downward until the magnet 98 engages the top wall 23 of the cabinet. The knobs 106 are then tightened to secure the hanger bracket 92 in its adjusted position.

It may be desirable in some cases to provide the door panels in separate upper and lower sections, each having a pair of hinge assemblies of the type described herein, and with the upper and lower sections being separately installed on the cabinet side walls, one directly above the other, generally in the manner heretofore described herein. Once both door assemblies are properly installed on the cabinet side wall panels, the two assemblies preferably are selectively interconnected to act as a single door for all functional purposes. With this optional alternative, the individual door assemblies will be lighter in weight and more easily handled during installation, also customization of the overall size (height) of the door can be accomplished by offering one or more of the upper and lower sections in various heights, such as a standard height lower door section and various height upper door sections.

It should be understood, of course, that the specific forms of the invention herein illustrated and described are intended to be representative and not limiting. Reference should be made to the following appended claims in determining the full scope of the invention.

What is claimed is:

1. A door system comprising:

a door panel;

a hinge assembly secured to the door panel;

the hinge assembly having a base forming a mounting surface operable to mount to a vertical surface of a support;

the door panel being operable to pivot about a vertical pivot axis when the hinge assembly is mounted to the vertical surface;

the hinge assembly having at least one magnet operable for magnetic connection to a metallic portion of the vertical surface; and the magnet being selectively movable relative to the base into a connected position wherein the magnet is positioned to magnetically mount the hinge assembly to the vertical surface, and the magnet being selectively movable into a disconnected position wherein the magnet is displaced in a direction perpendicular to the mounting surface of the base, relative to the connected position, and is positioned to allow removal of hinge assembly from the vertical surface.

2. A door system as in claim 1, comprising:

the magnet having a contact surface;

in the connected position, the contact surface of the magnet being substantially coplanar with the mounting surface of the base of the hinge assembly; and in the disconnected position, the contact surface of the magnet being substantially spaced from the mounting surface of the base.

3. A door system as in claim 1, comprising:

the hinge assembly having a cylindrical recess fixed relative to the base and the cylindrical recess having first threads;

the hinge assembly having a magnet carrier, the magnet carrier having a cylindrical portion with second threads engaged with the first threads of the cylindrical recess; and the magnet being connected to the magnet carrier and the magnet being selectively movable into the connected and disconnected positions by rotation of the magnet carrier relative to the base.

4. A door system as in claim 3, comprising:

the first threads of the cylindrical recess being internal threads and the second threads of the magnet carrier being external threads.

5. A door system as in claim 3, comprising:

the magnet carrier having a manually engageable gripping element for controlled rotation of the magnet carrier with respect to the base to selectively move the magnet into the connected and disconnected positions.

6. A door system as in claim 1, comprising:

the hinge assembly having a vertically aligned registration tab projecting from the base and adapted to engage a vertical slot in the vertical support structure.

7. A door system as in claim 6, comprising:

two of said hinge assemblies are provided with said registration tabs.

8. A door system as in claim 1, comprising:

a vertically adjustable leveling foot being mounted to the hinge assembly, and the leveling foot being operable to engage a floor surface.

9. A door system as in claim 1, comprising:

a vertically adjustable door support assembly mounted to the hinge assembly; the door support assembly including a hanger bracket of inverted L-shaped configuration having vertical and horizontal bracket elements;

a magnet secured to the horizontal bracket element for engagement with a horizontal support; and the vertical bracket element being connected to the base of the hinge assembly and being vertically adjustable with respect to the base.

10. A door system as in claim 9, comprising:

the base of the hinge assembly has a lateral extension, and the vertical bracket element being connected to the lateral extension.

11. A door system as in claim 10, comprising:

the lateral extension of the base having a plurality of outwardly projecting threaded studs;

the vertical bracket element having a plurality of vertically elongated slots aligned with said threaded studs; and an internally threaded knob engaging each of the threaded studs for manually securing the vertical bracket element to the lateral extension.

12. A door system as in claim 1, comprising:

a data center having a first row of equipment cabinets;

the vertical support surface comprising a first side wall of an equipment cabinet in the first row; and the hinge assembly being mounted to the first side wall.

13. A door system as in claim 12, comprising:

a second row of equipment cabinets and an aisle between the first and second row; and the door panel extending into the aisle.

14. A door system comprising:

a door panel;

a hinge assembly secured to the door panel;

the hinge assembly having a base forming a mounting surface operable to contact a vertical support;

the hinge assembly having at least one magnet operable for magnetic connection to a metallic portion of the vertical support;

the magnet being selectively movable relative to the base into a connected position wherein the magnet is positioned to magnetically mount the hinge assembly to the vertical support, and the magnet being selectively movable into a disconnected position wherein the magnet is positioned to allow removal of hinge assembly from the vertical support;

the hinge assembly having a cylindrical recess fixed relative to the base and the cylindrical recess having first threads;

the hinge assembly having a magnet carrier, the magnet carrier having a cylindrical portion with second threads engaged with the first threads of the cylindrical recess; and the magnet being connected to the magnet carrier and the magnet being selectively movable into the connected and disconnected positions by rotation of the magnet carrier relative to the base.

15. A door system as in claim 14, comprising:

the first threads of the cylindrical recess being internal threads and the second threads of the magnet carrier being external threads.

16. A door system as in claim 14, comprising:

the magnet carrier having a manually engageable gripping element for controlled rotation of the magnet carrier with respect to the base to selectively move the magnet into the connected and disconnected positions.

17. A door system as in claim 14, comprising:

the magnet having a contact surface;

in the connected position, the contact surface of the magnet being substantially coplanar with the mounting surface of the base of the hinge assembly; and in the disconnected position, the contact surface of the magnet being substantially spaced from the mounting surface of the base.

18. A door system as in claim 17, comprising:

the base of the hinge assembly has a lateral extension, and the vertical bracket element being connected to the lateral extension.

19. A door system as in claim 18, comprising:

the lateral extension of the base having a plurality of outwardly projecting threaded studs;

the vertical bracket element having a plurality of vertically elongated slots aligned with said threaded studs; and an internally threaded knob engaging each of the threaded studs for manually securing the vertical bracket element to the lateral extension.

20. A door system comprising:

a door panel;

a hinge assembly secured to the door panel;

the hinge assembly having a base forming a mounting surface operable to contact a vertical support;

the hinge assembly having at least one magnet operable for magnetic connection to a metallic portion of the vertical support;

the magnet being selectively movable relative to the base into a connected position wherein the magnet is positioned to magnetically mount the hinge assembly to the vertical support, and the magnet being selectively movable into a disconnected position wherein the magnet is positioned to allow removal of hinge assembly from the vertical support;

a vertically adjustable door support assembly mounted to the hinge assembly; the door support assembly including a hanger bracket of inverted L-shaped configuration having vertical and horizontal bracket elements;

a magnet secured to the horizontal bracket element for engagement with a horizontal support; and the vertical bracket element being connected to the base of the hinge assembly and being vertically adjustable with respect to the base.

* * * * *